United States Patent [19]

Fleissner

[11] 4,268,941

[45] May 26, 1981

[54] PROCESS FOR THE CONTINUOUS SHRINKING OF YARNS

[75] Inventor: Hans Fleissner, Riehen/Basel, Switzerland

[73] Assignee: Vepa Aktiengesellschaft, Riehen/Basel, Switzerland

[21] Appl. No.: 39,891

[22] Filed: May 17, 1979

[30] Foreign Application Priority Data

May 19, 1978 [DE] Fed. Rep. of Germany ..... 2822026

[51] Int. Cl.[3] ..... D02J 1/22

[52] U.S. Cl. ..... 28/281; 8/149.1; 68/DIG. 5

[58] Field of Search ..... 8/149.1; 68/DIG. 5; 26/18.5; 28/281

[56] References Cited

U.S. PATENT DOCUMENTS

| | | | |
|---|---|---|---|
| 3,374,646 | 3/1968 | Fleissner | 68/DIG. 5 |
| 3,728,076 | 4/1973 | Fleissner | 8/149.1 |
| 3,785,017 | 1/1974 | Jacob et al. | 28/281 |
| 3,833,975 | 9/1974 | Cahnman et al. | 28/281 |
| 3,835,490 | 9/1974 | Fleissner | 8/149.1 |
| 3,936,918 | 2/1976 | List et al. | 28/281 |
| 3,949,453 | 4/1976 | List et al. | 28/281 |
| 3,965,511 | 6/1976 | Fleissner | 8/149.1 |

*Primary Examiner*—Robert Mackey

*Attorney, Agent, or Firm*—Craig and Antonelli

[57] ABSTRACT

A process for the continuous shrinking of textiles includes initially exposing the material to the effect of a hot treatment liquid prior to placing the material on a curved support, and then, to obtain complete shrinkage, allowing the same treatment medium to flow through the material, disposed loosely on the support, and thereafter drying the material and setting the material on a sieve drum under a suction draft. In this process a plurality of twisted yarn threads are shrunk in the wet state together in parallel, side-by-side relationship at temperatures of about 85°-95° C.; the threads are then cooled by cold water and, subsequently, are deposited without tension on a sieve drum subjected to a throughflow of a heated gas to further develop the thus-obtained shrinkage. During this heating step, the threads are initially gradually dried in a cooling temperature range of from 50°-60°, compressed, optionally by differences in the speeds of successive sieve drums. Then shrinkage is set, by gas being drawn through the threads, which are further guided in parallel to one another at a temperature of 180°-200°C.

6 Claims, 2 Drawing Figures

PROCESS FOR THE CONTINUOUS SHRINKING OF YARNS

The invention relates to a process for the continuous shrinking of endless or continuous textile material by initially exposing the textile material to the effect of a hot treatment liquid prior to placing the material on a curved support, and then, to obtain complete shrinkage, allowing the same treatment medium to flow through the material, disposed loosely on the support, and thereafter drying the material and setting the material on at least one sieve drum under a suction draft.

One process is known from DOS [German Unexamined Laid-Open Application] No. 1,785,165 for the production of nonwoven fiber materials consisting at least in part of fibers which shrink under the effect of heat. This process illustrates a procedure making it possible to trigger shrinkage of a length of material having a certain width uniformly over the surface area and to produce even after the shrinking step a smooth fleece. The essential advantage of this process resides in the correct utilization of the step of passing a flowing medium through the fleece, during shrinking as well as setting, and in the also ensured continuous transportation of the fleece while guiding the fleece absolutely without tension.

It is also conventional to treat yarn threads continuously for bulking. In the process of DOS No. 2,422,370, a single yarn is subjected, for this purpose, to two different treatments in succession. In the first treatment, the yarn is shrunk under minimum tensile stress in a moist atmosphere at temperatures around 80° C. In the second treatment zone, the yarn, for setting the crimp, is exposed on a revolving spindle unit to a saturated steam atmosphere at a temperature of about 120° C. This process has the disadvantage of a low production yield, since only a single yarn thread can be shrunk and set in a machine according to this process. However, the way in which the treatment liquor is effective on the deposited yarn is likewise low in efficiency, ensuring only conditionally a uniform treatment result.

The invention is based on the object of developing a process for the continuous shrinkage and setting, i.e. the known heat-setting of yarn threads, by means of which a plurality of parallel-guided threads can be conducted simultaneously through several treatment zones, thus producing optimum shrinkage. The development of the bulk is to approach the theoretically achievable maximum so that the product susbsequently manufactured from this yarn, such as carpets, for example, exhibits a permanently dense and voluminous or bulky appearance.

To attain the above object, the invention proposes initially to shrink, in the wet state, a plurality of twisted yarn threads lying together in parallel side-by-side relationship in a liquid bath, e.g. water, at elevated temperatures, e.g. between about 60° C. and the boiling temperature of the liquid, especially 85°-95° C. Thereafter, the threads are cooled by cold water and, likewise in the wet state are deposited without tension on a sieve drum under a throughflow of a heated gas to continue the initiated shrinking process, and to develop the thus-obtained shrinkage. In this procedure, the yarns are first of all to be dried gradually in the region of the saturation temperature (i.e. the temperature at which the drying gas no longer absorbs the liquid, e.g. water, otherwise a mist forms or condensation takes place), and are compressed optionally by different velocities of successive sieve drums (i.e. the differential speed between the first and second drums should be approximately 20% overfeed). In the present invenion, the temperature of the drying gas is to be set so that the drying gas is always a little warmer than the temperature of the water retained in the textile material, i.e. the thread. This results in a gradual drying process. Only thereafter, the shrinkage value is to be set in the threads, which are still conducted in parallel to one another, with gas drawn by suction through the threads, by elevating the temperature to 180°-200°C. Immediately following this step, the threads are to be cooled, preferably in a shock-like fashion.

An essential aspect in this process is not solely the continuous treatment of a plurality of threads guided in parallel, since this procedure alone is no longer novel. The important point is to trigger the shrinkage of the threads, just as in case of fleeces or nonwovens, in the wet state. This process has, heretofore, be considered impossible to carry out, because it was felt that there was the danger of entangling of the floating threads. By a controlled, exactly regulated delivery of the yarn threads to be shrunk into the sieve drum bath, and by maintaining the threads on the sieve drum under a suction draft, which sieve drum is rotating within the bath and serves as a fixed point, this danger has been eliminated. There is a substantial difference between the delivery speed of the threads before being immersed in the bath and the rotating speed of the sieve drum (i.e. approximately 20% overfeeding of the threads takes place on the sieve drum). Also, the subsequent units are to be driven at a controlled speed. In this connection, the hot-water shrinkage is to be temporarily frozen into the thread material by spraying cold water on the material. To retain a defined quantity of liquid on the threads, it is advantageous to dewater the threads subsequently, namely either by a press or preferably by a suction roll. If too small a quantity of liquid charge results in the step, remoistening must follow, in such a way that the threads are fed to the dryer in a state wherein they are just dripping wet.

Before depositing the parallel-guided threads, it is suitable in some cases to expose the threads in a controlled way to a slight longitudinal tension for a short period of time, namely, for example, by stretching by 0.5%. Subsequently, the threads are deposited without tension on the first rotating sieve drum in such a way that an additional, controllable, gradual shrinkage, a further development of the heretofore attained shrinkage effect, is obtained therein, namely at temperatures maintained at a low value in the inlet zone of the machine. The treatment temperature should range in the region of a saturation temperature range, i.e. between 50° and 60° C. To provide that the shrinkage is exactly controllable and no tangling of the threads can occur during the course of the setting step, all successive sieve drums should be controllable in their rotary speed independently of one another. In this way, additional compression or crimping and thus a further controlled shrinking of the threads is made possible. After shrinkage has been completed and developed in this manner, this shrinkage must be permanently set. For this purpose, the treatment temperature is raised to 180°-200° C., namely by introducing steam under pressure in the zone containing the threads. Depending on the type of fiber involved, it is also possible to effect the heat treatment of the threads by means of a gas, by sucking heated air through the threads. In any event, superheated steam is to be used for setting purposes in case of polyamide threads or yarn. It will be appreciated that essentially polyamides are treated by the process of this invention.

Another completing the setting step under heat, the setting result is to be frozen into place by shock-like cooling. For this purpose, the threads are guided on a sieve drum having a suction draft and are exposed to a throughflow of cold air.

After the shrinkage treatment, it is advantageous to conduct the parallel-guided threads over a compensatory storage unit and then wind up the threads, for example in groups of 100, on a beam.

The drawing shows an embodiment of an apparatus for conducting the process of this invention, wherein.

Figure 1:
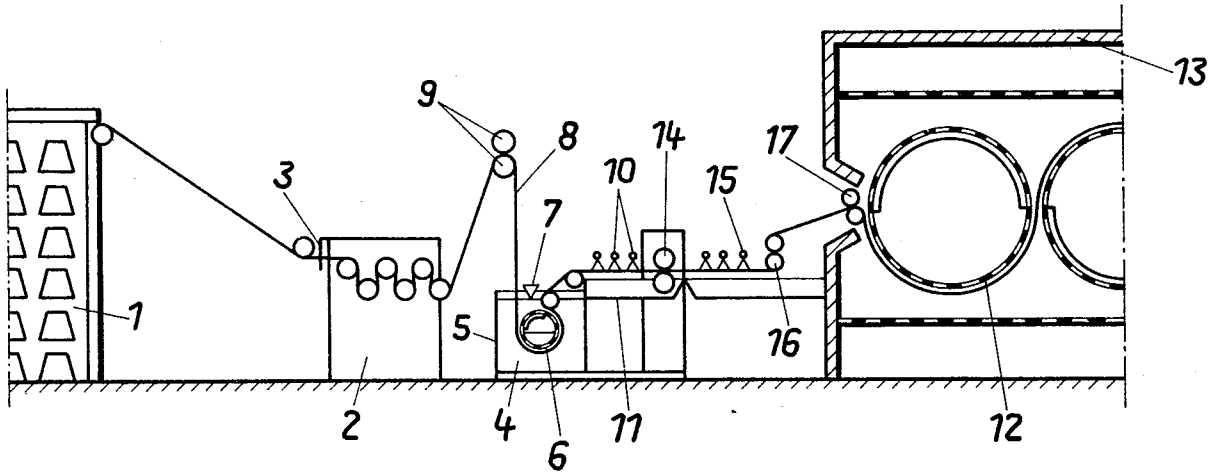
FIG. 1 shows a zone at the initial portion of a continuous plant.
Figure 2:
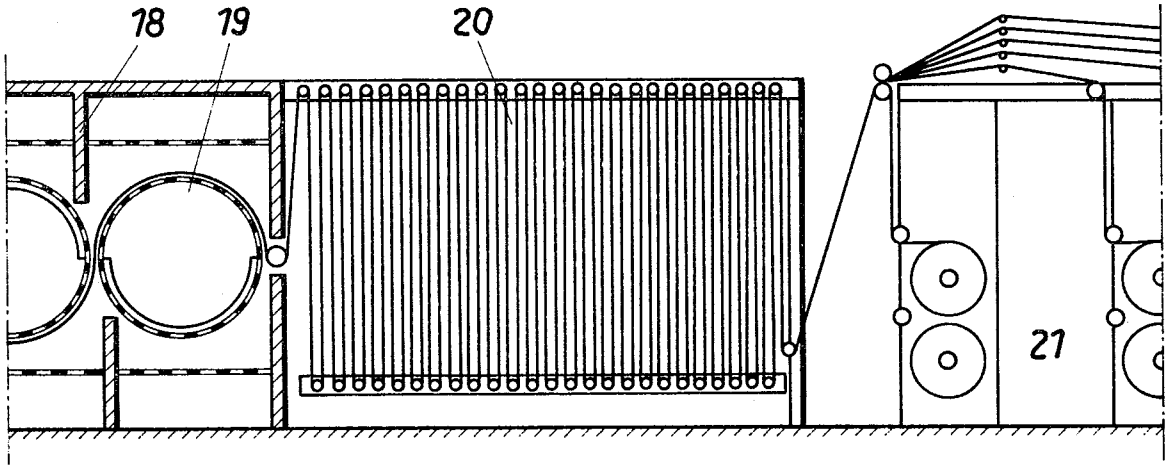
FIG. 2 shows the outlet end of the same plant.

At the beginning of the continuous plant, a bobbin creel 1 is provided receiving in several rows one behind the other and in side-by-side relationship a plurality of bobbins, e.g. 600 or 720 individual bobbins. A twisted yarn thread is taken off from each of these bobbins by means of a five-roller unit 2. Already at this point, all threads are positioned in uniform side-by-side relationship, which is effected particularly by a guide comb 3 engaging into the path of the threads, the threads being guided in a stretched fashion. A sieve drum shrinking path 4 follows the roller unit 2. In the housing 5 of this bath, a sieve drum 6 subjected to a throughflow of a treatment liquid from the outside toward the inside, is rotatably supported at a spacing underneath the liquid level 7. The threads 8, uniformly distributed over the width of the drum, drop perpendicularly into the liquid from a pair of squeeze rolls 9 arranged above the shrinking bath 4. In the liquid, the threads are initially allowed to shrink unguided and without contact on the curved support of the sieve drum 6. In the zone between the pair of squeeze rolls 9 and the sieve drum 6, which furthermore serves as a fixed point, such a high differential speed is set that the threads are neither guided in a stretched way in this zone nor are the threads allowed to floatingly entangle due to lack of adequate guidance. For this purpose, the drive mechanisms of the pair of squeeze rolls 9 and of the sieve drum are designed to be precisely regulatable in their respective driving speeds.

After the threads have traversed a certain height of the liquid freely within the shrinking bath 4, the threads are seized by the suction draft effective at the perforated or sieve surface of the sieve drum and are held in contact with the drum. Due to the tensionless transport of the threads 8 on the sieve drum 6 and due to the liquid throughflow, a further shrinkage is produced at this area. The suction draft is effective in the zone of the perforated surface covered by the material; the remaining portion of the sieve drum 6 is shielded from the suction draft.

Subsequently to passing through the shrinking bath, the threads are subjected to a cold-water quenching step. For this purpose, spray pipes 10 are associated with the threads 8. The draining water is collected by a trough 11 disposed therebelow. By means of this cold-water quenching step, the shrinkage condition is initially frozen or fixed into the yarn material.

To be able to set this shrinkage condition permanently, a heat treatment is now required. During this heat treatment, the shrinkage is to be further developed. Therefore, the threads are fed in the wet state to a first sieve drum 12 of the setting unit 13, which sieve drum is under a suction draft. To provide a definite amount of liquid on the threads, the threads 8 are initially dewatered after quenching with the aid of the pair of squeeze rolls 14. Subsequently, a defined amount of liquid is again applied onto the threads by spray pipes 15. This takes place with a water application of between 50 and 100%, measured with respect to the dry textile material. Between the following guiding and holding unit 16 and the sieve drum feed roller pair 17, a minor longitudinal tensile stress is exerted on the threads 8 to stretch the threads for example, by 0.5% before the heat treatment. By means of the pair of feed rollers 17, the threads are placed on the sieve drum 12 in slightly folded condition, i.e. transported without any tension. On the drum, a gas heated to approximately the saturation temperature level flows through the material. Thus, a slight drying effect is accomplished so that the threads can continue to shrink and/or the previously produced shrinkage can be developed.

After drying the threads on the initial two drums in the sieve drum unit 13, the gas in the last drum is heated to 180°–200° C., and the shrinkage value is set. In case of the polyamide yarns, super-heated steam is required for this purpose.

At the end of the setting step, a shock-like cooling of the threads is provided, on a sieve drum 19 under a throughflow of cold air, shielded by partitions 18 from the sieve drum unit 13. This cooling drum 19 is followed by a compensatory storage unit 20 and then by a creel 21 for storing beams. On a plurality of these beams, the shrunk threads are wound up, for example with respectively 100 threads.

What I claim is:

1. A process for the continuous shrinking of textile material by initially exposing the material to the effect of a hot treatment liquid prior to placing the material on a curved support, allowing the same hot treatment liquid to flow through the material, disposed loosely on the support to obtain complete shrinkage, and thereafter drying the material and setting the material on sieve drums under a suction draft, characterized by the steps of shrinking a plurality of twisted yarn threads in the wet state together in parallel, side-by-side relationship at temperatures of from about 60° to the boiling point of the treatment liquid; then cooling the threads by cold water and subsequently, in the wet state, to continue the thus initiated shrinking process, depositing the threads without tension on a first sieve drum of a plurality of successive drums subjected to a through flow of a heated gas, to develop the thus obtained shrinkage, during which the threads are initially gradually dried in the region of the saturation temperature limits, and compressed by differences in the speeds of the successive sieve drums, and only thereafter setting the shrinkage value, by drawing a gas heated to a temperature of from 180° to 200° C. through the threads which are further guided in parallel to one another on another sieve drum of said plurality of successive drums.

2. A process according to claim 1, wherein the twisted yarn threads are formed of a polyamide.

3. A process according to claim 1, wherein the threads, after completing the setting treatment, are then shock-like cooled by a cold gas being drawn through the threads.

4. A process according to claim 3, wherein the threads, after the cold water cooling step, are dewatered, while disposed in parallel to one another, and are then again moistened.

5. A process according to claim 4 wherein the threads are dewatered by applying a suction to the threads.

6. A process according to one of claims 1, 3 or 4, wherein the threads are stretched by a minor extent prior to the heat treatment on the sieve drums subjected to a throughflow of the heated gas.

* * * * *